US010674581B2

(12) United States Patent
Hu et al.

(10) Patent No.: US 10,674,581 B2
(45) Date of Patent: Jun. 2, 2020

(54) OPTIMIZING MULTICHANNEL LUMINAIRE CONTROL USING A COLOR EFFICIENT MATRIX

(71) Applicant: SIGNIFY HOLDING B.V., Eindhoven (NL)

(72) Inventors: Jia Hu, Brookline, MA (US); Meg Smith, Eindhoven (NL); Patricia Rizzo, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/484,866

(22) PCT Filed: Feb. 12, 2018

(86) PCT No.: PCT/EP2018/053425

§ 371 (c)(1),
(2) Date: Aug. 9, 2019

(87) PCT Pub. No.: WO2018/153713

PCT Pub. Date: Aug. 30, 2018

(65) Prior Publication Data

US 2020/0077485 A1 Mar. 5, 2020

Related U.S. Application Data

(60) Provisional application No. 62/462,183, filed on Feb. 22, 2017.

(30) Foreign Application Priority Data

Mar. 7, 2017 (EP) ..... 17159509

(51) Int. Cl.
*H05B 45/20* (2020.01)
*F21V 9/02* (2018.01)

(52) U.S. Cl.
CPC ..... *H05B 45/20* (2020.01); *F21V 9/02* (2013.01)

(58) Field of Classification Search
None
See application file for complete search history.

(56) References Cited

U.S. PATENT DOCUMENTS

2006/0078198 A1* 4/2006 Bawolek ..... G01J 3/52 382/167
2007/0040512 A1 2/2007 Jungwirth et al.
(Continued)

FOREIGN PATENT DOCUMENTS

DE 102012209252 A1 12/2013
EP 1972183 B1 3/2015
(Continued)

*Primary Examiner* — Crystal L Hammond
(74) *Attorney, Agent, or Firm* — Daniel J. Piotrowski

(57) ABSTRACT

The described embodiments relate to multichannel luminaires (102, 212, 404) that employ a color coefficient matrix (CCM) that can be used to adjust an operation of the multichannel luminaires according to their contribution of light to an area (112, 402). The CCM can be generated based on images captured within the area and/or a software simulation that approximates the contribution of light from the multichannel luminaires to the area. Once the CCM has been generated, the CCM can be used to compensate control signals to each multichannel luminaire in order to provide more accurate color rendering and uniform light distribution. Furthermore, feedback from embedded sensors (206) in the multichannel luminaires and/or sensors (116, 208, 210, 418) in the area can provide further basis for compensating control signals according to the qualities of the natural and artificial light entering the area, and the effects of different surfaces (128) on the light.

7 Claims, 7 Drawing Sheets

(56) References Cited

U.S. PATENT DOCUMENTS

| | | | | |
|---|---|---|---|---|
| 2011/0069094 | A1* | 3/2011 | Knapp | G09G 3/2003 345/690 |
| 2013/0057157 | A1 | 3/2013 | Nackaerts et al. | |
| 2014/0160720 | A1* | 6/2014 | Seuntiens | E04B 9/32 362/2 |
| 2014/0320024 | A1 | 10/2014 | Adler | |
| 2015/0296589 | A1 | 10/2015 | Melanson et al. | |
| 2015/0359061 | A1 | 12/2015 | Adler | |
| 2017/0150112 | A1* | 5/2017 | Wu | H04N 9/07 |
| 2018/0320376 | A1* | 11/2018 | Di Trapani | E04B 9/32 |

FOREIGN PATENT DOCUMENTS

| | | | |
|---|---|---|---|
| WO | 2011033444 | A1 | 3/2011 |
| WO | 2015143469 | A1 | 10/2015 |

* cited by examiner

OPTIMIZING MULTICHANNEL LUMINAIRE CONTROL USING A COLOR EFFICIENT MATRIX

CROSS-REFERENCE TO PRIOR APPLICATIONS

This application is the U.S. National Phase application under 35 U.S.C. § 371 of International Application No. PCT/EP2018/053425, filed on Feb. 12, 2019, which claims the benefit of U.S. Provisional Patent Application No. 62/462,183, filed on Feb. 22, 2017 and European Patent Application No. 17159509.3, filed on Mar. 7, 2017. These applications are hereby incorporated by reference herein.

This invention was made with government support under Contract No. DE-EE0007103 awarded by the United States Department of Energy. The government has certain rights in this invention.

TECHNICAL FIELD

The embodiments set forth herein relate to techniques for controlling multichannel luminaires. More particularly, the embodiments herein relate to systems, methods, and apparatuses for controlling a network of multichannel luminaires using a color coefficient matrix.

BACKGROUND

Lighting control can prove difficult in areas that are illuminated by single channel luminaires that can only be adjusted for brightness. Furthermore, single channel luminaires may not be able to adequately mimic natural light under certain circumstances where an area is illuminated by both natural and artificial light. As a result, a person moving within the area may be distracted by inconsistencies between lighting conditions in the area. Furthermore, when natural light is not effectively leveraged to illuminate an area, energy consumption of the luminaires may become unnecessarily excessive.

SUMMARY

The described embodiments relate to systems, methods, and apparatuses for mimicking natural light and promoting uniform light distribution using multichannel luminaires that are controlled according to a color coefficient matrix (CCM). For example, in some embodiments, a computing device is set forth that includes a processor and a memory that is configured to store instructions that when executed by the processor, cause the processor to perform steps that include: identifying a channel of a multichannel luminaire that is located in an area that includes a network of multichannel luminaires. The steps can also include accessing a color coefficient matrix (CCM) to identify a CCM value that indicates a proportion of light the channel contributes to the area, and causing a control signal for the multichannel luminaire to be compensated based on the CCM value. The CCM can identify individual multichannel luminaires in the network of multichannel luminaires and can include values corresponding to a portion of light each channel of each multichannel luminaire contributes a location in the area. The steps can further include receiving a selection of a setting value associated with a change in lighting for the area, wherein causing the control signal to be compensated can include performing linear optimization using the setting value and the CCM value. The steps can also include receiving feedback from one or more sensors that detect features of light that being distributed within the area. The feedback can include data corresponding to color temperature of natural light entering the area.

In other embodiments, a method is set forth for generating data for compensating a control signal for a multichannel luminaire. The method can be performed by a computing device and include steps of receiving a first image captured when a channel of a multichannel luminaire was operating in an area according to a first setting. The steps can also include receiving a second image captured when the channel was operating in the area according to a second setting, identifying, using the first image and the second image, contributions of light by the channel to the area at the first setting and the second setting, and generating a control compensation value based on the contributions of light to the area. The steps can further include storing the control compensation value as part of a color coefficient matrix, and compensating controls signals for a network of multichannel luminaires using the color coefficient matrix. The first image and the second image can include direct light from the multichannel luminaire to a location in the area, and indirect light that has reflected from a surface to the location in the area. Additionally, generating the control compensation value can include quantifying an amount of direct light and indirect light from the multichannel luminaire to the location. The method can also include steps of receiving a selection of a third setting that is different than the first setting and the second setting, and providing the control signal to the multichannel luminaire based on the control compensation value. The first image and the second image can be high dynamic range (HDR) images in some embodiments.

In yet other embodiments, a multichannel luminaire is set forth as including lights that each output a different color of light, and a memory configured to store a color coefficient matrix (CCM). The CCM can include values associated with a proportion of light that each of the lights contributes to an area illuminated by the lights. The multichannel luminaire can also include a processor connected to the lights and the memory, and the processor can be configured to provide control signals to the lights based on the values in the CCM. In some embodiments, the processor is further configured to maintain a combined color output of the lights using a ratio value stored by the memory. The multichannel luminaire can also include an embedded sensor connected to the processor and configured to provide the processor with feedback data associated with a luminance and/or a color of artificial light incident at a location. The embedded sensor can be configured to provide an image to the processor for recalibrating the CCM to adapt to changes in light distribution in the area.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/ housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
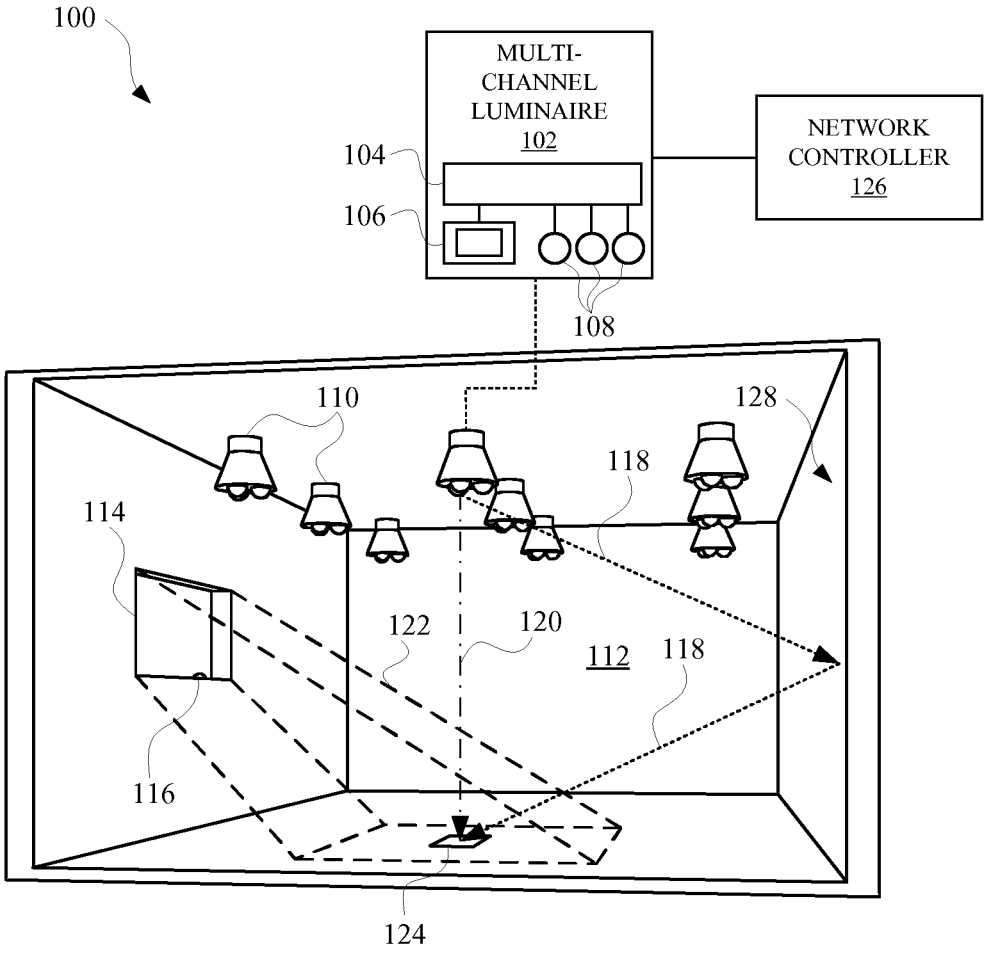
FIG. 1 illustrates an area that is illuminated by multiple multichannel luminaires that mimic natural light using at least a control loop and/or a color coefficient matrix (CCM).

The described embodiments relate to systems, methods, and apparatuses for mimicking natural light using multichannel luminaires that are controlled according to a color coefficient matrix (CCM). Natural light can be mimicked in a number of ways, including combining artificial light and natural light, which is a process that not only results in a better lighting environment, but can also reduce energy consumption. Although single channel luminaires can be employed to mimic natural light, single channel luminaires typically operate according to a single set point of brightness level. Unfortunately, such luminaires cannot usually account for the various characteristics of natural light beyond brightness. Multichannel luminaires, however, provide a versatile lighting alternative that can use feedback to constantly adapt to a changing natural light source. Specifically, a network of multichannel luminaires can be in communication with a controller that uses sensor data and a color coefficient matrix to accurately mimic natural lighting in an area, provide a more uniform distribution of light, and adapt to environmental changes such as occupancy rates and other environmental changes.

A controller can be connected to multiple different sensors for measuring characteristics of natural light entering an area, as well as the characteristics of the artificial light provided by the multichannel luminaires. For example, a sensor can be arranged to provide the controller with data associated with an amount of red, green, and/or blue light that is in the natural light, the intensity of the natural light, the color temperature of the natural light, and/or any other data suitable for characterizing the natural light. The controller can use the data from the sensor as feedback when controlling the multichannel luminaires. The sensors can be arranged at any location where natural light is observable, such as near windows, doors, and/or outside. As that natural light changes over time, the controller can adjust dimming levels, correlated color temperature (CCT) and/or any other features of one or more channels of the multichannel luminaires in order to adapt the light output of the multichannel luminaires. Such adjustments can improve aesthetics, reduce energy consumption, and/or provide biophilic benefits. In some embodiments, each multichannel luminaire can include one or more sensors that can detect various properties of the light directly output by each multichannel luminaire, an occupancy of an area, a temperature of an area, natural light properties, and/or any other features of an area that can affect lighting of the area. The output of such sensors can be used as feedback for the multichannel luminaires to further adapt their output to changing conditions in an area.

The operation of the controller can be further optimized to account for spatial differences in an area, surface colors, furniture arrangement, occupancy patterns, and/or any other feature of an area that can affect how light is perceived in an area. The effects of spatial differences on light distribution in the area can be compiled and used to formulate a color coefficient matrix (CCM) for one or more multichannel luminaires in an area. A CCM can be stored in a memory accessible (directly or indirectly through one or more intermediate computing nodes) to the multichannel luminaire such that individual control compensation can be undertaken for each multichannel luminaire. In this way, not only can the multichannel luminaires be compensated based on sensor data, but also based on their individual contribution to the lighting of an area, as reflected in the CCM.

The CCM for a multichannel luminaire can be calculated according to one or more different methods. For example, the CCM can be calculated using an analytical method and/or a technique involving analyzing high dynamic range (HDR) images. In some embodiments, the HDR images can be captured by an image sensor of a multichannel luminaire, an image sensor located in an area illuminated by a multichannel luminaire, and/or a device, such as a cellular phone, that is operated by a user and allows the user to control the multichannel luminaire. The HDR images can be used to derive photometric data that can represent the light contribution of each multichannel luminaire to various reference locations in an area. By providing the light contribution for each multichannel luminaire, a CCM can be derived that reflects the contribution of light to an area by each multichannel luminaire.

In order to capture HDR images that are appropriate for deriving a CCM, a camera can be placed at various reference locations in an area illuminated by multichannel luminaires. For each multichannel luminaire, one or more HDR images can be captured. For example, a multichannel luminaire can be set at a first dimming level when a first HDR image is captured, and a second dimming level when a second HDR image is captured. Each HDR image can contain data RGB (i.e., red, green, blue) byte data per pixel, and can be used to calculate light intensity, false color, illuminance, surface reflectance, and/or any other metric related to lighting. In order to calculate the lighting contribution of the multichannel luminaire for the CCM, total light from the multichannel luminaire at the first dimming level and second dimming level can be calculated based on the first HDR image and the second HDR image. Additionally, an amount of direct light at a reference location for each dimming level can be calculated for the multichannel luminaire based on the first and second HDR images. An amount of indirect light at the reference location can be calculated for each dimming level by subtracting the amount of direct light from the total light. A contribution coefficient for the CCM for the multichannel luminaire can then be calculated based on how the light at the reference location changes with dimming level. In some embodiments, a contribution coefficient can be provided for each dimming level of each multichannel luminaire. In yet other embodiments, a contribution coefficient can be used to estimate a suitable dimming level for a multichannel luminaire given a desired color or brightness value.

Mathematically, the CCM can be represented in some embodiments as $C(t)=c_{ij}(t)$, where t is a color type (e.g., red, green, blue), and $c_{ij}(t)$ is the value of a contribution coefficient for a luminaire i that is projecting light with a color type t to location j. In order to calculate $c_{ij}(t)$ using the analytic method, light reflectance data and/or photometric data is broken down to determine how individual multichannel luminaires contribute to the lighting of an area. Each individual multichannel luminaire i can have a direct and indirect lighting contribution to a reference location j. The direct lighting contribution can be calculated from the photometric data and/or simulation software. Indirect light can be light from multichannel luminaire i that has reflected from a surface. The surface can have a particular reflectance, which can be accounted for when calculating the overall lighting contribution of the multichannel luminaire. The indirect lighting contribution can be calculated using a three-dimensional (3D) model of the area that is illuminated by the multichannel luminaire. The 3D model can include information related to the color and layout of the area, reflectance of surfaces, as well as the objects that are included in the area, such as tables, pictures, and surface textures.

Control signals for each multichannel luminaire can be based on the CCM, light intensity measurements, CCT, color measurements, and/or any other metric related to the lighting of the area illuminated by the multichannel luminaire. For example, CCT and/or light intensity requirements can be set by a controller and/or a user that is operating a device for controlling the lights. In some embodiments, the controller can store one or more CCMs and in other embodiments each multichannel luminaire can store a CCM. When a multichannel luminaire stores a CCM, any control signal sent to the multichannel luminaire can be compensated for influences of surface color, surface reflectance, natural light conditions, and/or any other factor affecting lighting of the area.

As an area changes, preferences are adjusted, and/or luminaires age, re-calibration of the CCM can be performed. Re-calibration can be performed by recapturing HDR images of an area and processing the HDR images to identify changes in the characteristics used for calculating the CCM. Alternatively, the CCM can be re-calibrated regularly using a camera of a person that is regularly controlling the multichannel luminaires and/or using cameras located in areas illuminated by the multichannel luminaires.

In some embodiments, linear optimization can be used to optimize the control signal for each channel of each multichannel luminaire. By performing linear optimization, a controller or multichannel luminaire can ensure that a desired color and/or luminance for a particular area has minimal differences from the color and intensity of a light source. This process can be performed using a closed loop controller that iteratively adjusts the dimming level of a multichannel luminaire to minimize differences between the luminaire's intensity and the illuminance at a particular location. A ratio of light intensity, or other light characteristic, between channels of a multichannel luminaire can remain unchanged during the linear optimization process in order to maintain the desired color and/or CCT requirement.

FIG. 1 illustrates a diagram 100 of an area 112 that is illuminated by multiple multichannel luminaires 110 that mimic natural light (or provide a predetermined light effect) using at least a control loop and/or a color coefficient matrix (CCM). Each multichannel luminaire 102 of the multichannel luminaires 110 can include a controller 104 that controls an output of each red, green, and blue light sources 108 (e.g., each light source 108 may include, for instance, one or more LEDs of the same color). Furthermore, each multichannel luminaire 102 can include a sensor 106 that can detect characteristics of light in the area 112. For example, in some embodiments, the sensor 106 can detect characteristics of natural light 122 entering through a window 114, and/or artificial light provided by the multichannel luminaire 102. Furthermore, in some embodiments, the sensor 106 can detect various features of the area 112 such as occupancy, arrangement of objects in the room, color of surfaces, reflectance of surfaces, textures of surfaces, and/or any other characteristic that can influence the distribution of light in the area 112. However, the sensor 106 can be an optional feature for the multichannel luminaires 110.

Each multichannel luminaire 102 of the multichannel luminaires 110 can be connected to each other and/or a network controller 126. The network controller 126 can store data associated with each multichannel luminaire 102, the area 112, and/or any other data suitable for use when providing a control signal to a multichannel luminaire 102. In some embodiments, the network controller 126 can store high dynamic range (HDR) images corresponding to various reference locations, such as reference location 124. The HDR images can provide information related to how light is distributed throughout the area 112. For example, HDR images can be captured when only the multichannel luminaire 102 is illuminating the area 112. Additionally, HDR images can be captured at different dimming levels of the multichannel luminaire 102 in order to provide information on how each dimming level is affecting the light provided to the reference location 124. The information derived from the HDR images can be used by the network controller 126 to control each multichannel luminaire 102 of the multichannel luminaires 110.

In some embodiments, a natural light sensor 116 can provide data to the network controller 126 and/or the multichannel luminaires 110 so that the multichannel luminaires 110 can be adjusted according to the natural light 122 entering the area 112. For example, the natural light sensor 116 can measure the color (e.g., red, green, and/or blue) and/or light intensity of natural light 122 being provided to an area 112. The network controller 126 can use the measurements in order to adjust each color light source 108 of each multichannel luminaire 102 to match the color values of the natural light 122. Furthermore, a dimming level of each multichannel luminaire 102 can be adjusted such that a combined light intensity of the natural light 122 and artificial light will correspond to a set point of the network controller 126.

Although the lighting in the area 112 can be optimized using the closed loop control that incorporated feedback from various sensors, the lighting in the area 112 can be further improved by deriving a color coefficient matrix (CCM). The CCM can be used to compensate control signals from the network controller 126 to each of the multichannel luminaires 110. The CCM can be generated, e.g., by the network controller 126 or by another computing device, based on images captured at the area 112, and/or other information corresponding to the space and arrangement of the area 112. The images can be processed, e.g., by the network controller 126 or by another computing device, to identify photometric data and/or space layout information for the area 112. The photometric data and space layout information can be used to identify how light intensity is distributed for each multichannel luminaire 102. For example, a CCM can be calculated for reference location 124 according to how indirect light 118 reflects from a wall 128 to the reference location 124, how much direct light 120 illuminates the reference location 124, and/or how much natural light 122 illuminates the reference location 124. Each source of light can be affected by environmental differences in the area 112, therefore, by calculating a CCM that accounts for the light contribution of each light source, each of the multichannel luminaires 110 can be more accurately controlled. For example, the wall 128 can be composed of a material that is more reflective than a material located at the reference location 124, and therefore the indirect light 118 will have a non-negligible contribution of light to the reference location 124. By compiling the CCM based on how each multichannel luminaire 110 contributed to multiple different reference locations in the area 112 at multiple different dimming levels, the CCM can be used to more accurately mimic natural light and operate the multichannel luminaires 110 more efficiently.

In some embodiments, the CCM can be stored in a memory of the controller 104 of each multichannel luminaire 110, in the network controller 126, and/or elsewhere (e.g., on one or more remote computing devices forming what is commonly referred to as the "cloud"). Any control signals provided to the multichannel luminaires 110 can be based on measurements from one or more sensors such as sensor 106, and be compensated using the CCM. For example, when a dimming level adjustment is made, e.g., by the network controller 126, in response to changes in the natural light 122, a control signal corresponding to the dimming level adjustment can be modified using the CCM. In some embodiments, linear optimization can be performed by the controller 104 and/or the network controller 126. In other embodiments, linear optimization may be performed on one or more remote computing devices, such as on the cloud. Linear optimization can be performed using CCM values to identify an optimal dimming level that will minimize differences between the desired light color and/or intensity at a reference location and the light intensity and/or color of an artificial light source. A CCM can be validated and/or re-calibrated from time to time to account for environmental changes in the area 112 and/or changes at the multichannel luminaires 110. Validation and/or re-calibration can be performed, e.g., by the network controller 126, which can receive updated images of the area from a sensor in the area 112 or a camera application that otherwise sends instructions to the network controller 126. For example, a person can use the camera application to make adjustments to the operation of the multichannel luminaires 110 as well as capture images that can be used as a basis for generating the CCMs.

Figure 2:
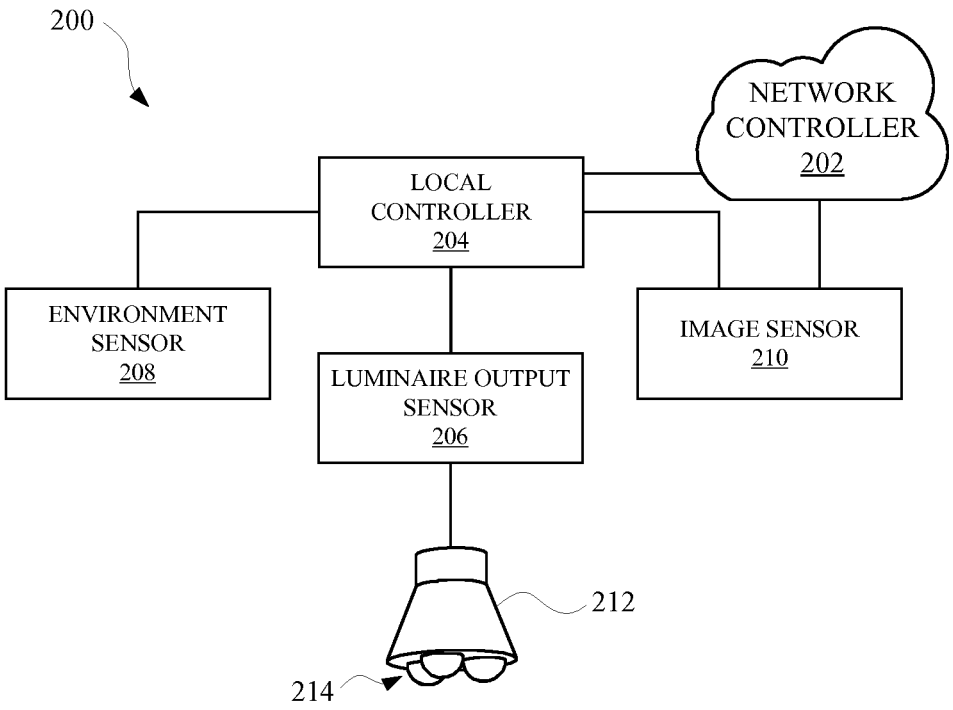
FIG. 2 sets forth a system diagram that illustrates how natural light can be mimicked using feedback from various sensors and a CCM.

FIG. 2 sets forth a system diagram 200 that illustrates how natural light can be mimicked or provide a predetermined light effect using feedback from various sensors and a CCM. The system diagram 200 includes a multichannel luminaire 212 that includes different color light sources 214, such as red, green, and/or blue, which allow the multichannel luminaire 212 to output different colors of light. Each light source 214 can correspond to an individual channel of the multichannel luminaire 212, and each channel can be separately controlled by a local controller 204 that is part of, or otherwise connected to, the multichannel luminaire 212. The multichannel luminaire 212 can also include a luminaire output sensor 206 that can measure the color and/or light intensity of the output of the multichannel luminaire 212. The luminaire output sensor 206 can be connected to the local controller 204 and provide the local controller 204 data based on the output of the multichannel luminaire 212. The local controller 204 can also be connected to an environmental sensor 208, which can be located in an area that can receive light from the multichannel luminaire 212. The environmental sensor 208 can provide signals to the local controller 204 in response to changes to characteristics of natural light entering the area where the environmental sensor 208 is located. For example, the environmental sensor 208 can measure the color content (e.g., red, green, blue) of the natural light and/or the light intensity of the natural light and provide measurement data to the local controller 204 and/or a network controller 202. The local controller 204 and/or the network controller 202 can use the measurement data as feedback when controlling the multichannel luminaire 212. Controls for the multichannel luminaire 212 can also be based on a CCM that can be generated to compensate control signals according to how each multichannel luminaire 212 distributes light within an area.

In some embodiments, the CCM can be generated based on images, such as HDR images, that can be captured by an image sensor 210 that can be located in the same area as the multichannel luminaire 212. For example, the image sensor 210 can be a camera that is attached to a portable device, such as a cell phone, and the camera can operate under the direction of an application that can control settings of the multichannel luminaires 212. The image sensor 210 can provide the images to the local controller 204 and/or the network controller 202 so that the CCM can be derived using the images. Alternatively, the portable device can generate the CCM using the images and provide the CCM to the local controller 204 and/or the network controller 202 (or to the cloud) for controlling each of the light sources 214. The images can be captured at multiple different reference locations and under multiple different settings of different multichannel luminaires. In this way, the CCM can represent how each multichannel luminaire 212 contributes to the light in an area at different dimming levels. Furthermore, the CCM can be used to compensate control signals based on each multichannel luminaire's contribution to the overall lighting in the area.

Figure 3:
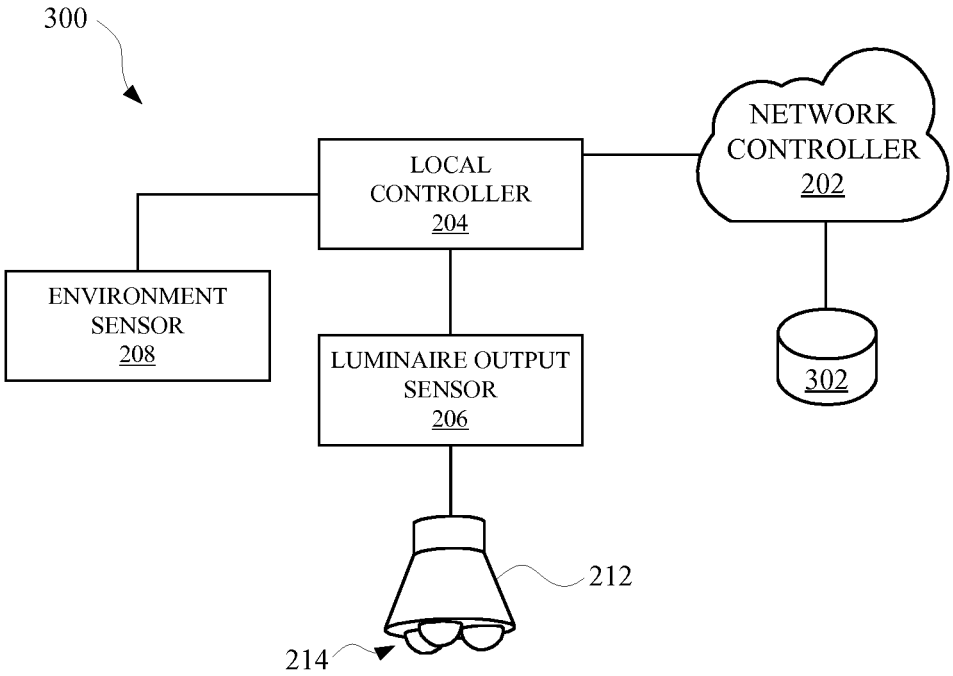
FIG. 3 sets forth a system diagram that illustrates how natural light can be mimicked using feedback from various sensors and a CCM that is created based on a software model of an area.

FIG. 3 sets forth a system diagram 300 that illustrates how light can be more accurately rendered by multichannel luminaires that use feedback from various sensors and a CCM that is created based on a software model of an area. The software model can be stored in a memory device 302 that is accessible to the network controller 202. The software model can be based on images taken of the area where the multichannel luminaire 212 is located, and/or other data related to the area. For example, the software model can be generated by the network controller 202 using data that identifies features of the area such as layout, occupancy patterns, objects within the area, materials that makeup the structure of the area, reflectance of surfaces within the area, location and dimension of windows and entry ways in the area, and/or any other data suitable for indicating how light will be distributed within an area. Once the software model is created, the software model can simulate various lighting configurations, such as the use of different dimming levels, to identify how light from different multichannel luminaires 212 gets distributed at different grid points of the software model. Using this simulation, the network controller 202, and/or any other device capable of running the simulation, can generate a CCM that can be provided to the local controller 204 or otherwise be used to provide control signals to each multichannel luminaire 212. The CCM can be reflective of how each multichannel luminaire 212 in a simulated area affects the lighting at different grid points of the simulated area at different dimming levels.

It should be noted that the system diagram 300 includes the elements as described with respect to FIG. 2, except that the network controller 202 is illustrated as being in communication with the memory device 302. Furthermore, the network controller 202 can optionally be in communication with the image sensor 210 for controlling the multichannel luminaires 212 and/or validating or calibrating the CCM. In some embodiments, re-calibration or regeneration of the CCM can be performed when data is provided to the network controller 202 indicating that the area where the multichannel luminaires 212 has changed. Data regarding the area can be provided by a user who is inputting the data to the network controller 202, the luminaire output sensor 206, and/or the environment sensor 208. For example, if furniture in an area is shifted, the CCM can be updated in real-time based on images captured by the luminaire output sensor 206 and/or the environmental sensor 208.

Figure 4A:
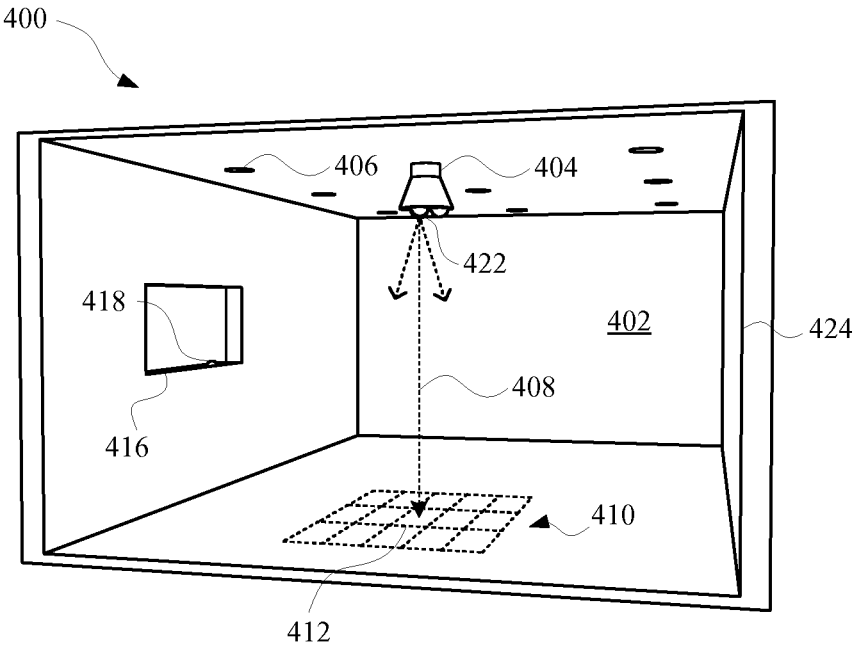
FIGS. 4A and 4B illustrate diagrams of how a color coefficient matrix (CCM) can be calculated.
Figure 4B:
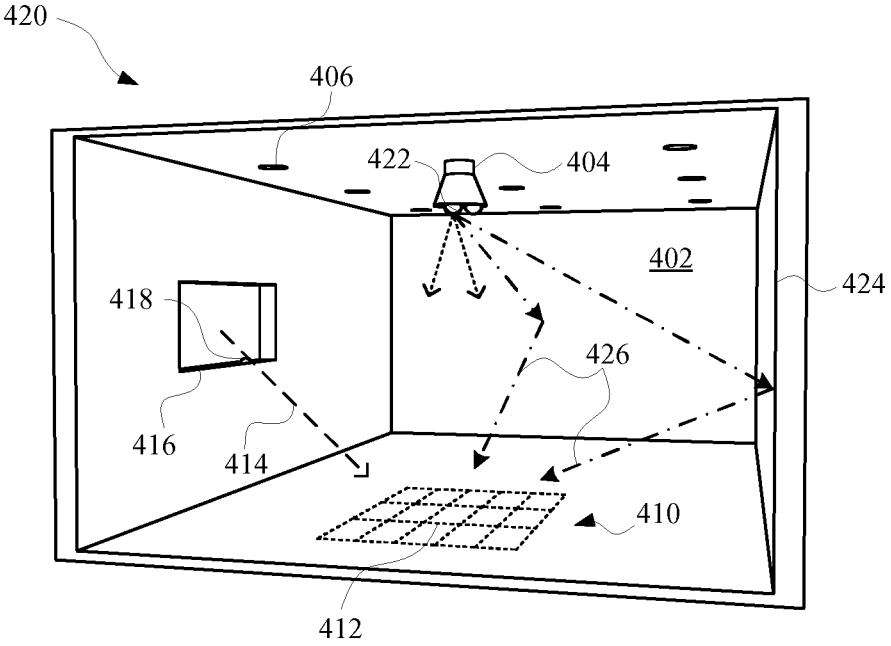

FIGS. 4A and 4B illustrate diagrams 400 and 420 of how a color coefficient matrix (CCM) can be calculated. Specifically, diagram 400 provides an actual or simulated area 402 where multiple multichannel luminaires 404, 406 can be arranged to illuminate the area 402. When the CCM is calculated based on an actual area 402, images of the area 402 can be captured when a multichannel luminaire 404 in the area 402 is operating at different dimming levels, and other multichannel luminaires 406 are not operating. When the CCM is calculated based on a simulated area 402, the simulation can provide data that indicates how light from the multichannel luminaire 404 will be distributed in the area 402 at different dimming levels. The images and/or the simulation can be broken down into a grid 410 and each reference location 412 on the grid 410 can be analyzed to determine how the reference location 412 is illuminated by the multichannel luminaire 404. For example, diagram 400 illustrates how direct light 408 from a channel 422 of the multichannel luminaire 404 can reach the reference location 412. Diagram 420 illustrates how indirect light 426 can reflect off walls of the area 402 in order to reach the reference location 412, as well as how natural light 414 can enter through an opening 416 of the area 402.

The CCM can be calculated using information related to how light is distributed in FIGS. 4A and 4B by the multichannel luminaire 404 at different dimming levels. In some embodiments, the CCM can be represented as C(t), and each value of the matrix can be represented as $c_{ij}$ (t), where t corresponds to a channel 422 and/or color type (e.g., red, green, or blue), i identifies the multichannel luminaire 404, and j corresponds to the reference location 124 in the grid 410. Each value $c_{ij}$ (t) for each channel 422 of each multichannel luminaire 404 at each location on the grid 410 can be calculated using Equation (1) below.

$$c_{ij}(t)=c_{ij}^{d}+c_{ij}^{i}=c_{ij}^{d}+\Sigma c_{is}r_{sj} \tag{1}$$

Each value of $c_{ij}$ (t) in the CCM can be a unitless number ranging from 0 to 1. However, in some embodiments, the values of the CCM can be any unitless number suitable for indicating how much light is being contributed to a reference location. In yet other embodiments, the values of the CCM can have units that represent an amount of light and/or color of light that is incident upon the reference location 412. The value $c_{ij}^{d}$ can represent a portion of direct light 408 from multichannel luminaire 404 *i* to reference location 412 *j*. The value $c_{ij}^{i}$ can represent a portion of indirect light 426 from multichannel luminaire 404 *i* to reference location 412 *s*, such as surface 424. The value $c_{is}$ can represent a portion of indirect light 426 reflected from a surface s, and the value $r_{sj}$ can represent a reflectance of a surface that the indirect light 426 reflects from. For example, the value for $c_{ij}$ (t) in the CCM can be 1 when a given multichannel luminaire 404 *i* is the only multichannel luminaire that contributes light to a reference location 412 *j*. Furthermore, the value for $c_{ij}$ (t) in the CCM can be 0.5 when a given multichannel luminaire 404 *i* contributes 50% of the light that is provided to the reference location 412 *j*, where 25% of the light is indirect light 426 and 25% is direct light 408. The value for $r_{sj}$ can be adjusted to represent the reflectance of the surface 424, which can result in the overall contribution of light from the multichannel luminaire 404 to the reference location 412 to be decreased or increased.

When using HDR images to calculate the CCM, various information about the light provided by a multichannel luminaire 404 can be gathered from the HDR images. Such information can include color data (e.g., RGB byte data), light intensity, illuminance, surface reflectance, and/or glare sources. When capturing the HDR images, a camera can be placed at each reference point of the grid 410 in order to collect images of each multichannel luminaire 404 individually illuminating each reference point at different dimming levels. In some embodiments, the camera can be the camera attached to a portable computing device such as a cellular phone that is operated by a person in the area 402. Images captured by the person, and the location data associated with the person in the room, can be used to derive the CCM. The location data can be based on a position coordinate sensor (e.g., global positioning system (GPS), Wi-Fi or cellular triangulation, etc.) operated by the portable computing device. For any of the CCM calculation methods, images corresponding to at least two dimming levels for each multichannel luminaire 404 can be captured at each reference location 412 of the grid 410. The resulting images can be analyzed in order to compile a CCM that can allow a controller to estimate each multichannel luminaire's light contribution to each reference location 412 at any dimming level. Contribution estimations can be based on Equation (2) below, which illustrates how a contribution coefficient can be derived from two different dimming levels.

$$c_{ij}(t)=c_{ij}^{d_2}c_i^{c*}(c_{ij}^{d_2}-c_{ij}^{d_2})/(d_1-d_2) \tag{2}$$

According to Equation (2), a contribution coefficient for dimming level "c" can be derived using $c_{ij}^{d_1}$ and $c_{ij}^{d_2}$, which are coefficients representing a portion of light at dimming levels $d_1$ and $d_2$ respectively, and $c_i^c$ represents a general coefficient for dimming level "c". By multiplying $c_i^c$ by $(c_{ij}^{d_1}-c_{ij}^{d_2})/(d_1-d_2)$ and adding the product to the coefficient at $d_2$, a linear estimation can be derived for any dimming level "c." In this way, changes to dimming levels of a multichannel luminaire 404 can be compensated according to the dimming level at which the multichannel luminaire 404 will be operating. Furthermore, this can reduce the number of images to be stored for compiling the CCM because only two dimming levels are actually observed or simulated when calculating Equation (2).

Other feedback can be used to optimize control signals sent from a controller to multichannel luminaires 404 in the area 402. For example, a sensor 418 can be used to detect features of natural light 414 that is entering the area 402. Such features can include the correlated color temperature (CCT) or color of the natural light 414 and intensity of the natural light 414. Furthermore, one or more of the multichannel luminaires 404 can include an embedded sensor for detecting the color and/or intensity of the light emitted by the one or more multichannel luminaires 404. The controller operating the multichannel luminaires 404 can then use the CCM, data from the sensor 418, and data from the embedded sensor to provide control signals to the multichannel luminaires 404. In some embodiments, linear optimization can be used to identify a dimming level that is most suitable for a desired color and/or luminance. For example, Equation (3) below can be solved to minimize f and solve for a luminance value L(t), which can be used to derive a dimming level for a multichannel luminaire.

$$\min f=\Sigma_t|L(t)*C(c,t)-e_0(c)| \quad (3)$$

The value C(c, t) can correspond to a CCM value for light source t at reference location c, and $e_0(c)$ can be a desired color and/or luminance value at location c. In some embodiments, as L(t) is calculated for a given multichannel luminaire t, a ratio of luminance and/or color values between channels of a multichannel luminaire can be maintained in order to reach a desired color and/or CCT setting.

The CCM can be validated and/or re-calibrated to ensure that the CCM is reflective of the arrangement of the area 402 at a given time. For example, the furniture in the area 402 can be moved around, causing the distribution of light from one or more multichannel luminaires 404 to change. In some embodiments, calibration can be performed by a user that is operating an application for controlling the multichannel luminaires 404 in the area 402. The application can be operating on a portable computing device that is capable of capturing images of the area 402 and processing the images, or sending the images to a network controller for processing. As a result of the processing, the CCM can be updated to reflect changes in how each multichannel luminaire 404 contributes to the light in the area 402.

Figure 5:
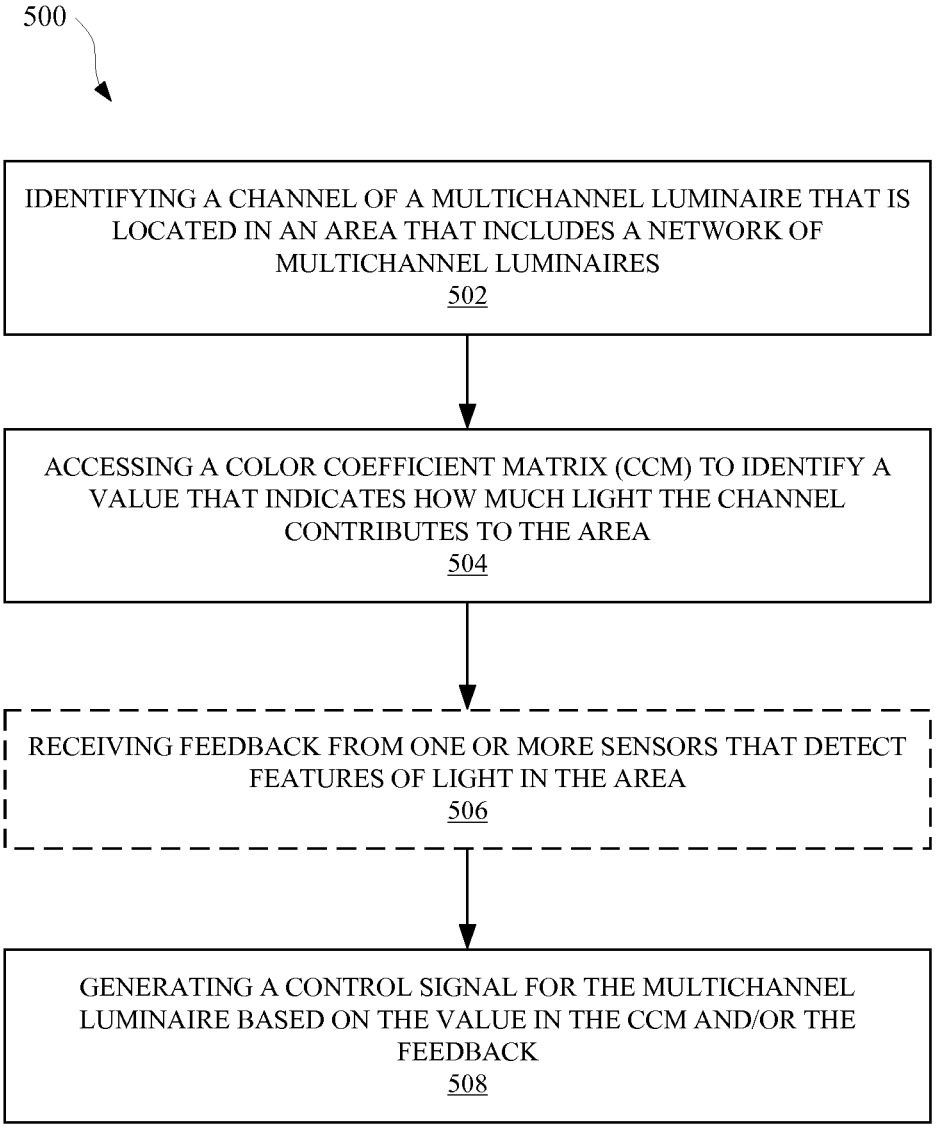
FIG. 5 illustrates a method for controlling a multichannel luminaire using a CCM.

FIG. 5 illustrates a method 500 for controlling a multichannel luminaire using a CCM. The method 500 can be performed by a controller that is embedded in the multichannel luminaire, a network controller that is in communication with the multichannel luminaire, a portable computing device, and/or any other device suitable for controlling a luminaire. The method 500 can include a block 502 of identifying a channel of a multichannel luminaire that is located in an area that includes a network of multichannel luminaires. The channel can correspond to a color of a light that is included in the multichannel luminaire. Furthermore, identifying the channel can include selecting the channel according to its location within the area. The method 500 can further include a block 504 for accessing a color coefficient matrix (CCM) to identify a value that indicates how much light the channel contributes to the area. For example, the value can be a unitless value that indicates what proportion of light the channel of the multichannel luminaire contributes to a reference location in the area. At block 506, which can be an optional block in the method 500, feedback is received from one or more sensors that detect features of light in the area. The feedback can include data that details light intensity, color, temperature, and/or any other feature of light that is naturally or artificially being provided to the area. At block 508 of method 500, a control signal is generated for the multichannel luminaire based on the value identified in the CCM and/or the feedback received from the one or more sensors. The method 500 can be repeated for each channel of each multichannel luminaire in the area in order that the control signals provided to the channels will be optimized according to how each channel contributes to the lighting in the area.

Figure 6:
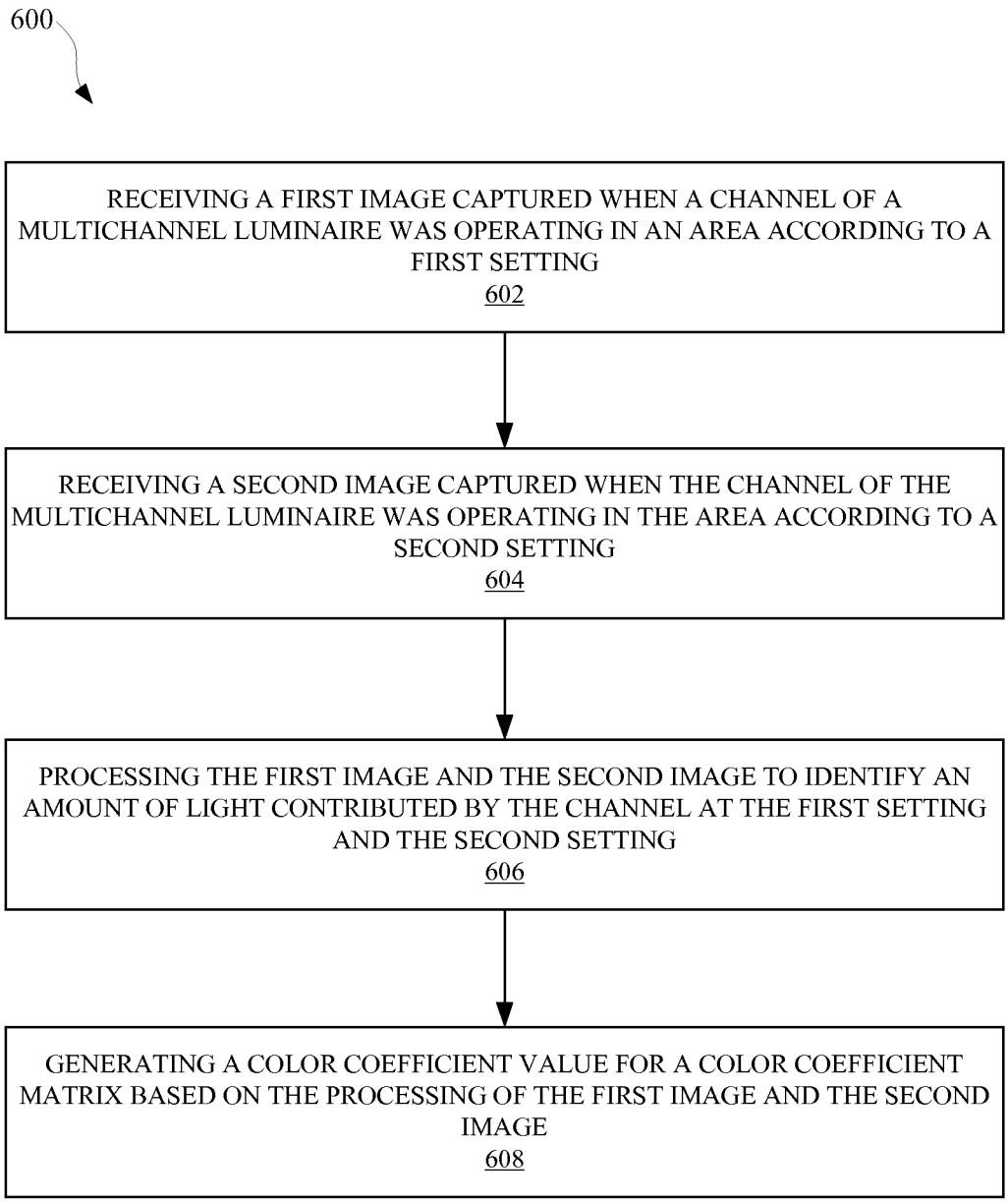
FIG. 6 illustrates a method for generating color coefficient values for a color coefficient matrix.

FIG. 6 illustrates a method 600 for generating color coefficient values for a color coefficient matrix. The method 600 can be performed by a controller that is embedded in the multichannel luminaire, a network controller that is in communication with the multichannel luminaire, a portable computing device, and/or any other device suitable for controlling a luminaire. The method 600 can include a block 602 of receiving a first image captured when a channel of a multichannel luminaire is operating in an area at a first setting (e.g., a first dimming level). The first image can be captured from the perspective of a reference location in the area where the multichannel luminaire is operating. Furthermore, the first image can be captured as or converted to an HDR image in order to render more information related to the distribution of light in the area. The method 600 can further include a block 604 of receiving a second image captured when the channel of the multichannel luminaire is operating in the area at a second setting (e.g., a second dimming level). The second image can also be captured from the perspective of the reference location, and can be captured as or converted to an HDR image. At block 606 of method 600, the first image and the second image can be processed to identify an amount of light distributed by the channel at the first setting and the second setting. For example, the first image and the second image can be processed to specifically identify how much direct light and indirect light the channel contributed to the reference location at the first setting and the second setting. At block 608 of method 600, a color coefficient value can be generated for a color coefficient matrix (CCM) based on the processing of the first image and the second image. Subsequently, the CCM can be used to compensate changes to the setting of the channel of the multichannel luminaire in order to more accurately and efficiently operate the multichannel luminaire.

Figure 7:
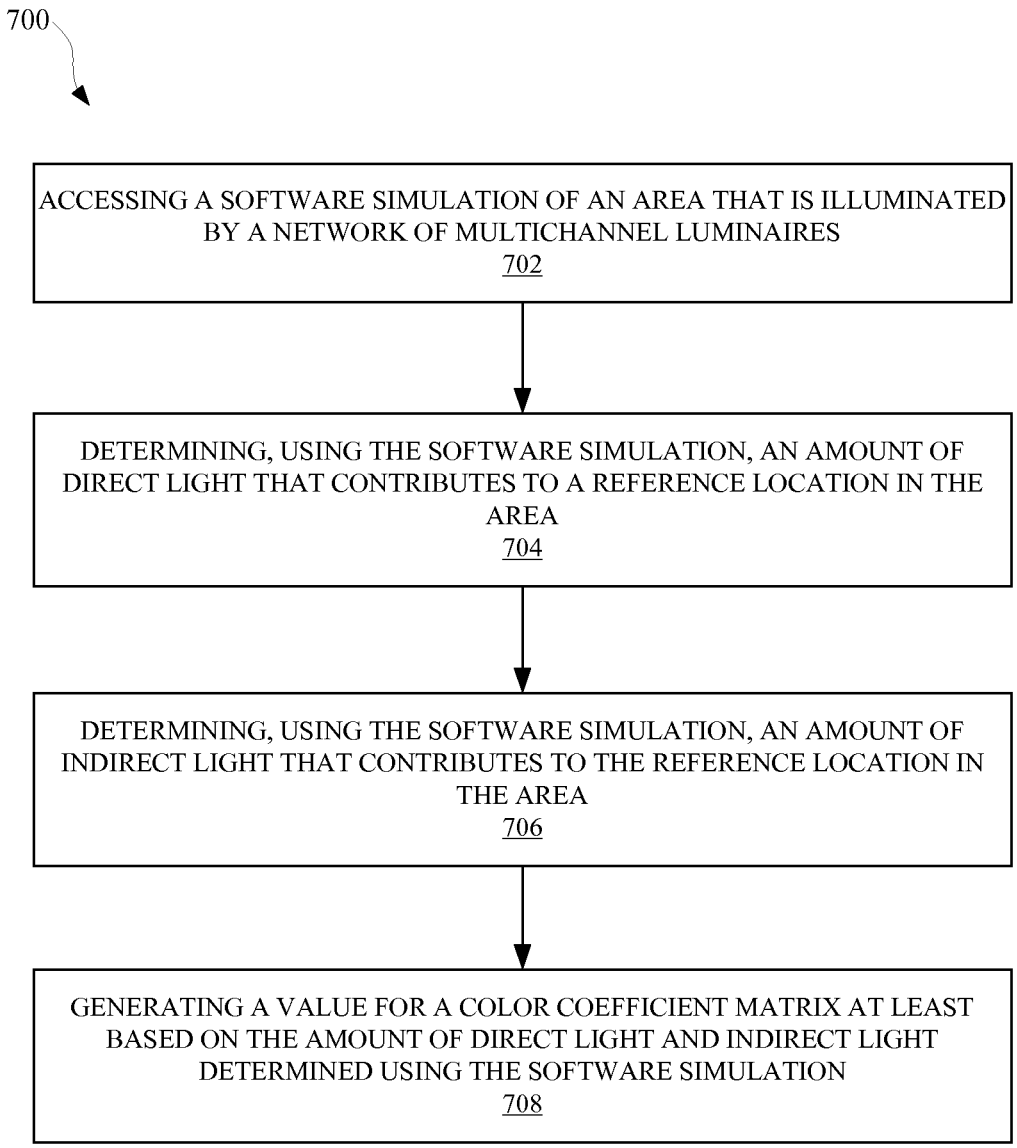
FIG. 7 illustrates a method for generating values for a CCM using a software simulation of an area.

FIG. 7 illustrates a method 700 for generating values for a CCM using a software simulation of an area. The method 700 can be performed by a controller that is embedded in the multichannel luminaire, a network controller that is in communication with the multichannel luminaire, a portable computing device, and/or any other device suitable for controlling a luminaire. The method 700 can include a block 702 for accessing a software simulation of an area that is illuminated by a network of multichannel luminaires. The software simulation can be updated using sensor data from a sensor in the area that can detect how the area changes over time. Such changes can include the shifting of furniture, movement of people in the area, modifications to the reflectiveness of surfaces, rearrangements of lights, and/or any other changes that can affect the distribution of light in the area. The method 700 can further include a block 704 of determining, using the software simulation, an amount of direct light that contributes to a reference location in the area. The reference location can correspond to a location on a floor, a wall, a piece of furniture, a ceiling, a door, and/or any other location that can be found in a room. The method 700 can also include block 706 for determining, using the software simulation, an amount of indirect light that contributes to the reference location in the area. Direct light can refer to light that moves between the multichannel luminaire and the reference location without reflecting from a visible surface, whereas indirect light refers to light that moves between the multichannel luminaire and the reference location by reflecting off at least one surface. At block 708, a value for a color efficient matrix can be generated based on the amount of direct light and indirect light determined using the software simulation.

Figure 8:
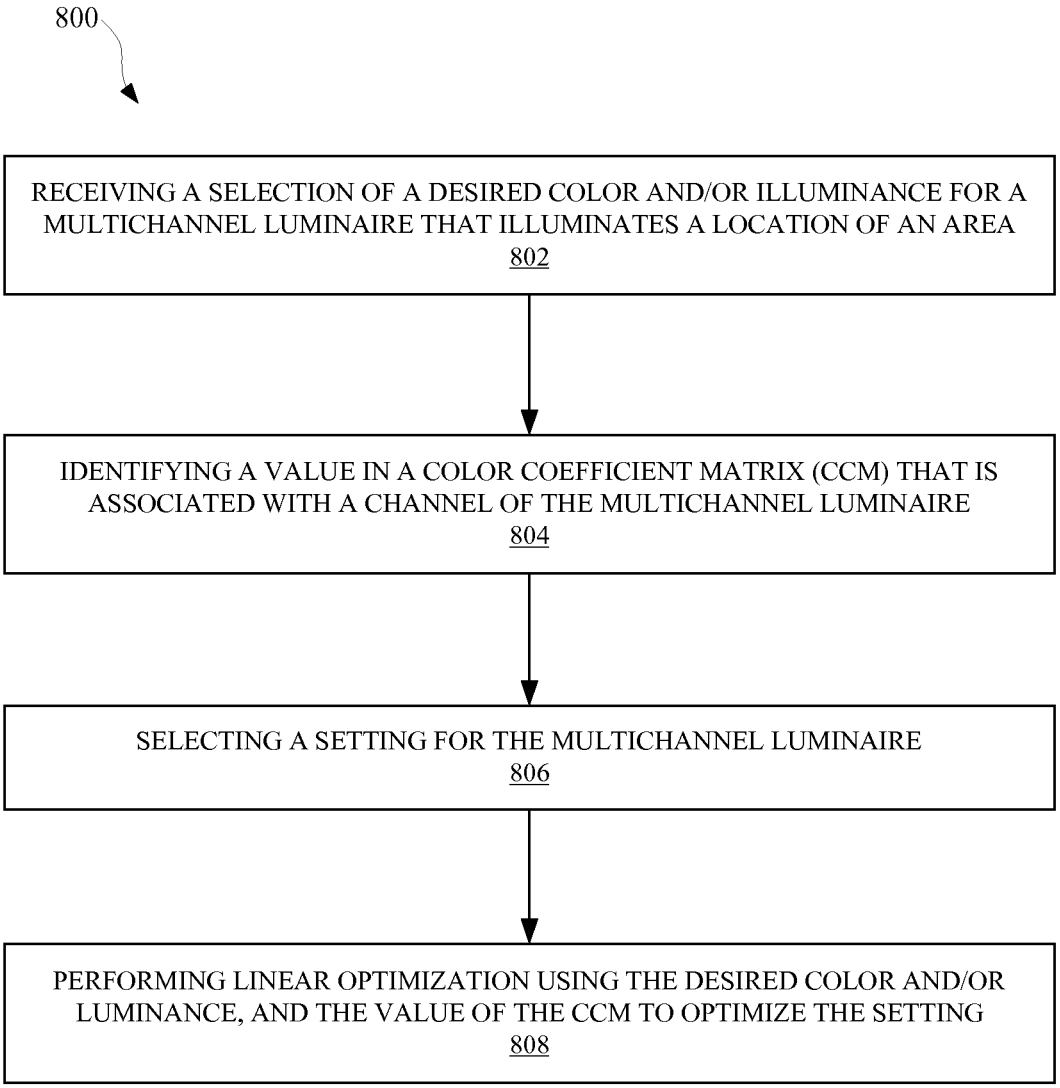
FIG. 8 illustrates a method for performing linear optimization to select a setting for a multichannel luminaire.

FIG. 8 illustrates a method 800 for performing linear optimization to select a setting for a multichannel luminaire. The method 800 can be performed by a controller that is embedded in the multichannel luminaire, a network controller that is in communication with the multichannel luminaire, a portable computing device, and/or any other device suitable for controlling a luminaire. The method 800 can include a block 802 for receiving a selection of a desired color and/or illuminance for a multichannel luminaire that illuminates a location in an area. The selection can be a signal that is communicated to a controller that can directly or indirectly control an operation of the multichannel luminaire. The signal can be provided by a controller or by a portable computing device that is operated by a user. At block 804, a value in a CCM is identified, and the value can be associated with a channel of the multichannel luminaire. The CCM can be stored in a memory that is embedded in the multichannel luminaire, or in a memory that is otherwise accessible to the controller that is controlling the multichannel luminaire. The method 800 can further includes a block 806 for selecting a setting for the multichannel luminaire. The setting can correspond to, for instance, a dimming level for one or more channels of the multichannel luminaire. In some embodiments, dimming levels of the channels of the multichannel luminaire can be set to a ratio of each other, therefore any adjusting to a dimming level of one channel can affect a dimming level of another channel. At block 808, linear optimization can be performed using the desired color and/or luminance, and the value of the CCM, in order to optimize the setting. Blocks 806 and 808 can repeated until the setting is sufficiently optimized. In some embodiments, the setting is optimized when a difference between the desired color and/or luminance values for a location, and a product of the setting and the CCM value, is minimized (as provided in Equation (3)).

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of" or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

The invention claimed is:

1. A computing device, comprising:

a processor; and a memory configured to store instructions that when executed by the processor, cause the processor to perform steps that include:

identifying a channel of a multichannel luminaire, wherein the multichannel luminaire includes a plurality of channels, wherein each channel is adapted to emit light with a particular color, wherein the multichannel luminaire is located in an area that includes a network of multichannel luminaires;

accessing a color coefficient matrix to identify a color coefficient matrix value that indicates a proportion of light a channel contributes to the area, wherein the color coefficient matrix identifies individual multichannel luminaires in an area with a network of multichannel luminaires and includes values corresponding to a portion of light each channel of each multichannel luminaire contributes to a light color in a location in the area at a respective dimming level; and generating a control signal for the multichannel luminaire to mimic natural light, by adjusting the contributions of light color of the channel to correspond to the value of the color coefficient matrix.

2. The computing device of claim 1, wherein the processor is further configured to receive a selection of a setting value associated with a change in lighting for the area, identify a value in the color coefficient matrix associated with a channel and causing the control signal to be compensated by performing a linear optimization using the setting value and the identified value in the color coefficient matrix.

3. The computing device of claim 1, wherein the processor is further configured to receive feedback from one or more sensors that detect features of light within the area.

4. The computing device of claim 3, wherein the feedback includes data corresponding to color temperature of natural light entering the area.

5. A multichannel luminaire, comprising:

multiple light sources that each output a different color of light;

a memory configured to store a color coefficient matrix, the color coefficient matrix comprising values associated with a proportion of light color that each of the light sources contributes to an area illuminated by the light sources; and a controller connected to the light sources and the memory, the controller configured to provide control signals to the light sources to mimic natural light, by adjusting contributions of light color of the multiple light sources to correspond to the values of the color coefficient matrix.

6. The multichannel luminaire of claim 5, further comprising:

an embedded sensor connected to the controller and configured to provide the controller with feedback data associated with a luminance and/or a color of artificial light incident at a location within the area.

7. The multichannel luminaire of claim 6, wherein the embedded sensor is further configured to provide an image to the controller for recalibrating the color coefficient matrix to adapt to changes in light distribution in the area.

* * * * *